US005755055A

United States Patent [19]

Thompson et al.

[11] Patent Number: 5,755,055

[45] Date of Patent: May 26, 1998

[54] SHOT SHELL BB HOLDER

[75] Inventors: Gregg Thompson, Columbus, Ga.; David C. Snyder, Palmyra; James M. Martin, Williamson, both of N.Y.; Casey Cerretani, Tumwater, Wash.

[73] Assignee: Crosman Corporation, East Bloomfield, N.Y.

[21] Appl. No.: 852,171

[22] Filed: May 6, 1997

[51] Int. Cl.[6] ..... F41C 23/00

[52] U.S. Cl. ..... 42/71.01; 42/87; 124/53

[58] Field of Search ..... 42/71.01, 90, 87, 42/88; 124/45, 51.1, 52, 53, 53.5

[56] References Cited

U.S. PATENT DOCUMENTS

| | | | |
|---|---|---|---|
| D. 286,669 | 11/1986 | Ballard | 42/71 R |
| 1,099,992 | 6/1914 | Micke | 42/6 |
| 1,517,420 | 12/1924 | Fritz | 42/71.01 |
| 1,734,852 | 11/1929 | Frampton | 42/87 |
| 2,092,361 | 9/1937 | Shirn | 273/107.5 |
| 2,375,106 | 5/1945 | Holcomb | 42/49 |
| 3,263,664 | 8/1966 | Bauer et al. | 124/45 |
| 3,638,344 | 2/1972 | Wagner | 42/71 R |
| 3,999,534 | 12/1976 | Chapin et al. | 124/74 |
| 4,020,974 | 5/1977 | Bauer et al. | 221/307 |
| 4,564,125 | 1/1986 | Esslinger | 221/288 |
| 4,723,531 | 2/1988 | Hampton | 124/45 |
| 4,850,127 | 7/1989 | Davis et al. | 42/71.01 |
| 4,860,478 | 8/1989 | Clayton | 42/71.01 |
| 4,967,723 | 11/1990 | Cutrell | 124/50 |
| 5,054,464 | 10/1991 | Young | 124/72 |
| 5,068,991 | 12/1991 | Reed | 42/71.01 |
| 5,094,024 | 3/1992 | Duke | 42/90 |
| 5,205,270 | 4/1993 | Szente | 124/50 |
| 5,361,746 | 11/1994 | Szente | 124/50 |

FOREIGN PATENT DOCUMENTS 34 08 637 A1 9/1985 Germany .

OTHER PUBLICATIONS

Davis Speedfeed Catalog.

*Primary Examiner*—Charles T. Jordan
*Assistant Examiner*—Meena Chelliah

[57] ABSTRACT

A BB holder for a gun comprises an elongated cylindrical body having a cylindrical side wall, a bottom wall, and an open top end and a cap having a cylindrical side wall which is ensleeved over the cylindrical side wall of the body. The holder has the shape and size of a shot gun shell and is stored in a chamber in the stock of a gun. If the gun has a BB reservoir, the BB reservoir can communicate with the chamber through a port opening which is closed when the holder is inserted into the chamber.

9 Claims, 3 Drawing Sheets

SHOT SHELL BB HOLDER

BACKGROUND AND SUMMARY

This invention relates to a BB holder for a gun, and, more particularly, to a BB holder which has a shape and size resembling a shot gun shell and which is mounted in the stock of the gun.

BB guns may include a reservoir or magazine for storing BB's. BB's are loaded into the reservoir by pouring BB's through a small port. The port can be closed with a slide type cover. For guns with no reservoir, BB's may be loaded individually into a track.

The invention provides a BB holder which allows additional ammunition storage, provides an aesthetically pleasing alternative to a port cover, and provides a convenient method of storing BB's.

The BB holder is a two piece plastic unit comprising a barrel or a body and a removable cap. The holder has the appearance of a 12 gauge shot gun shell and fits into a pocket or a chamber in the stock of a BB gun. If the gun includes a reservoir, a loading port in the chamber can be connected to the reservoir so that the gun can be loaded by pouring BB's into the chamber and through the loading port. The port is closed by inserting the hole into the chamber. A spring in the chamber applies axial pressure against the holder to retain the holder in the chamber.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
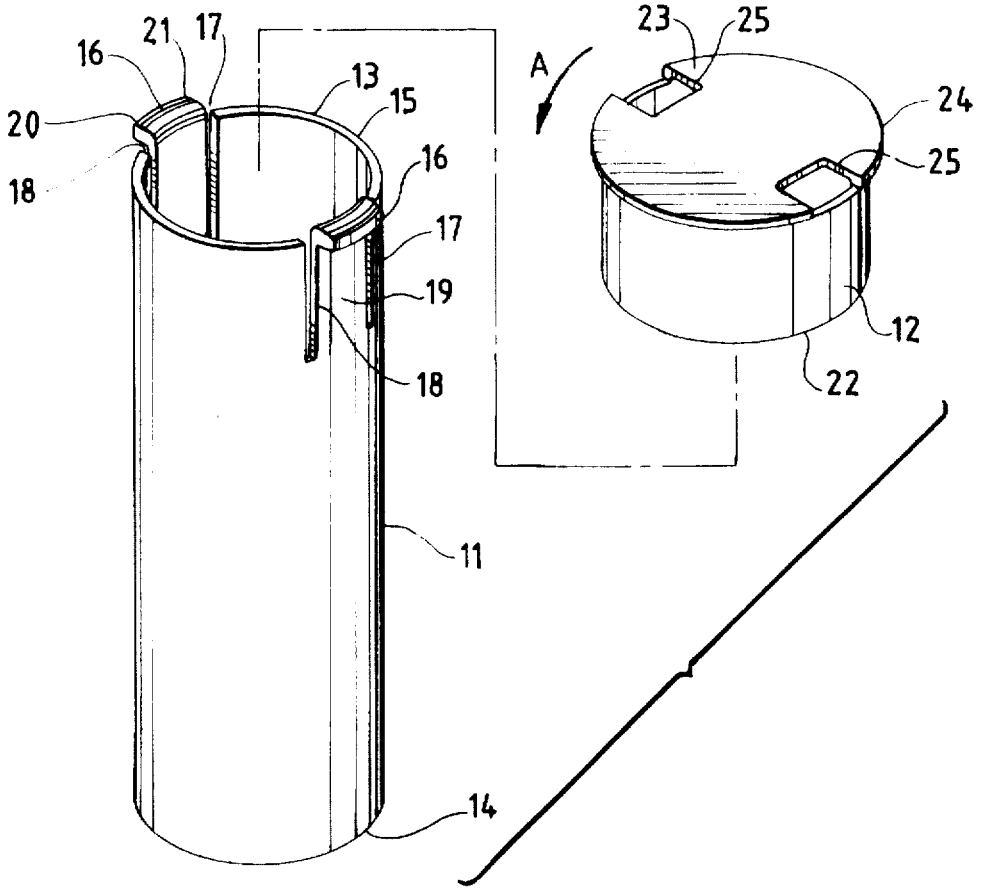
FIG. 1 is an enlarged perspective view of a BB holder formed in accordance with the invention.

Referring to FIG. 1, a BB holder 10 comprises a body 11 and a cap 12. The body is molded from plastic and includes a cylindrical side wall 13, a bottom wall 14 which closes one end of the body, and an open top end 15.

A pair of tabs 16 extend radially or laterally outwardly from the top end in diametrically opposed directions. A pair of slits 17 and 18 in the side wall 13 extend downwardly from the top end on opposite sides of each tap to provide a flexible and resilient mounting portion 19 for the tab. Each tab includes a top camming surface 20 and a side camming surface 21.

The cap 12 is also molded from plastic and includes a cylindrical side wall 22 having an open bottom end and a top wall 23. The top wall extends radially beyond the side wall to provide an annular rim or flange 24. A pair of openings 25 in the top wall are sized to receive the tabs 16.

The side wall 22 of the cap is sized to be ensleeved or telescoped over the side wall 13 of the body. The tabs 16 are cammed inwardly by the side wall 22 and the top camming surface 20. When the tabs pass through the openings 25, the tabs snap radially outwardly over the top edge of the side wall 22 to retain the cap on the body. The cap can be removed by rotating the cap in the direction of arrow A in FIG. 1 to engage the side camming surface 21. The tabs are cammed inwardly, and the cap can be pulled away from the body.

When the cap is positioned on the body, the holder has a shape and size which resembles a 12 gauge shot gun shell.

Referring to FIGS. 2–4 and 9, a gun 28 includes a frame 29 which is formed from right and left frame halves **29*a* and 29*b*. In the particular embodiment illustrated, each frame half is molded integrally from plastic and includes a stock portion 30 and a body portion 31**.

A firing assembly 33 (FIG. 9) is mounted in the frame for firing BB's through a barrel 34. The particular gun illustrated is an air gun which uses compressed air for firing the BB's. However, the gun can also be powered by pressurized $CO_2$, a spring, etc.

The firing assembly 33 includes a valve body 36 having a compression tube 37 for storing compressed air. A valve stem 38 is reciprocably mounted in the valve body for allowing compressed air to flow through an air passage from the compression chamber to a loader 39 which holds a BB in alignment with the barrel. A trigger 40 is connected to the valve stem for opening the air passage when the trigger is pulled.

A tubular BB magazine 42 is formed by ribs on the inside surfaces of the frame halves. A BB pusher 43 is slidably mounted in the magazine and is resiliently biased toward the loader 39 by a spring 44.

The firing mechanism is not part of this invention. Additional details of the firing mechanism can be found in the co-pending patent application entitled "Loader and Toggle Link Assembly for Gun" and filed of even date herewith, which is incorporated herein by reference.

Figure 9:
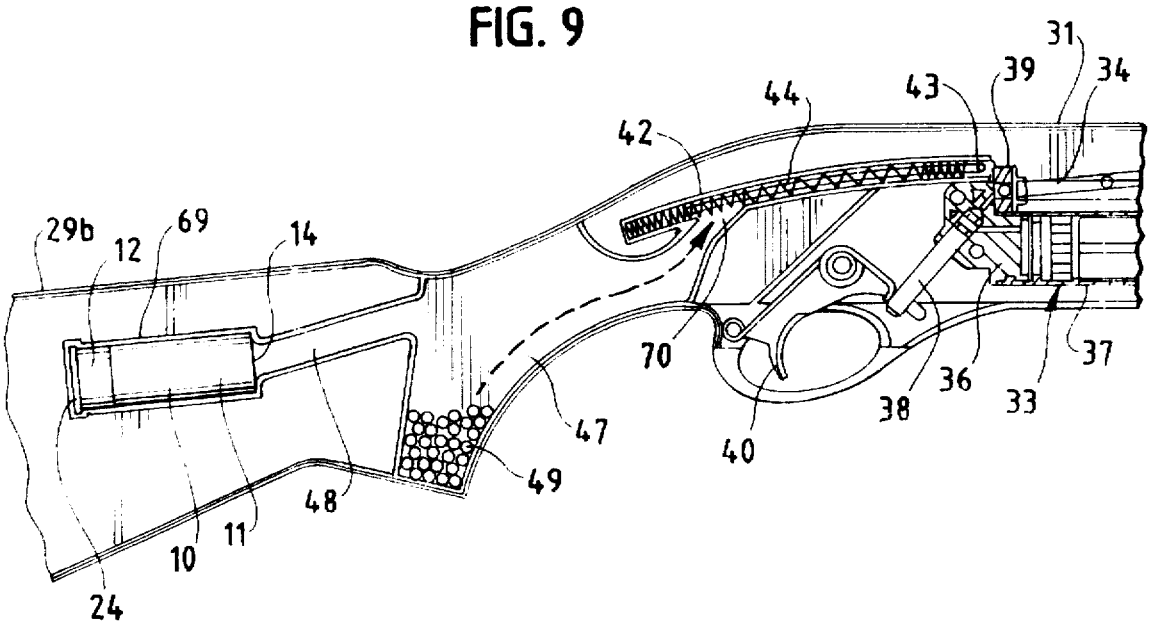
FIG. 9 is a fragmentary view of the left hand side of the gun.

The frame is provided with a chamber or pocket 46 (FIG. 2) for holding the BB holder 10. The chamber 46 is connected to a BB reservoir 47 (FIG. 9) in the frame through a loading port 48. The BB reservoir is also formed by ribs on the frame halves. When the BB holder 10 is inserted into the chamber 46 as shown in FIG. 9, the bottom wall 14 of the BB holder closes the port 48 and prevents BB's 49 from spilling out of the reservoir.

Figure 2:
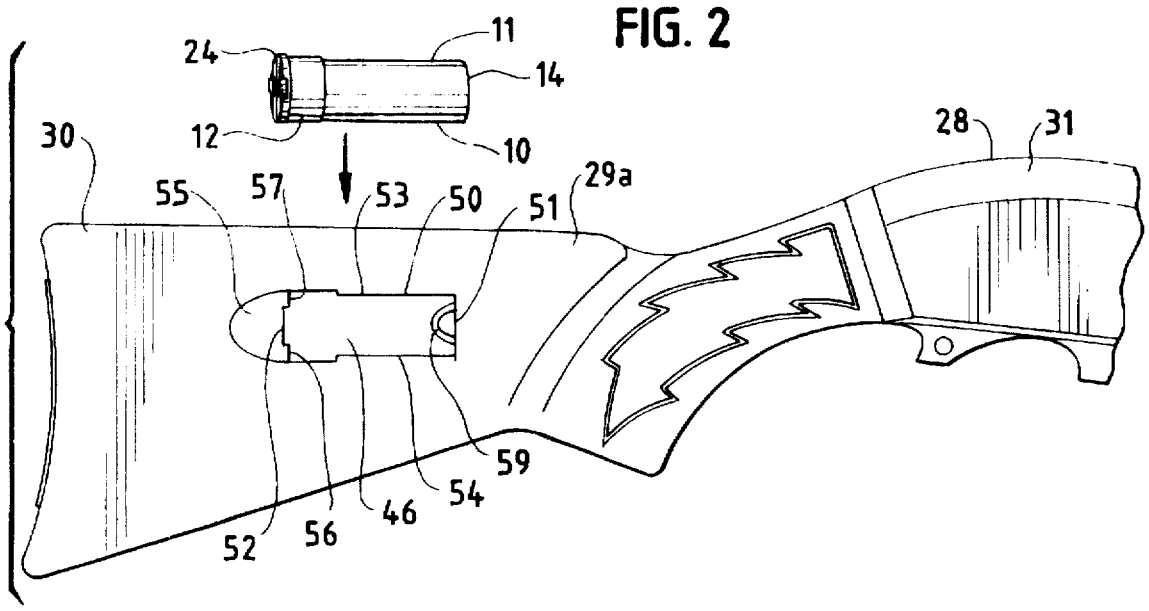
FIG. 2 is a fragmentary side view of a gun and a BB holder about to be inserted into the gun.
Figure 3:
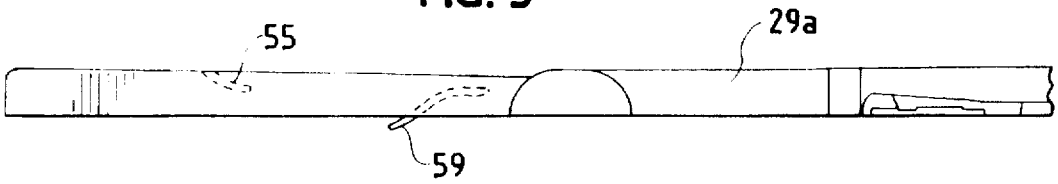
FIG. 3 is a bottom plan view of the right half of the gun of FIG. 2.
Figure 4:
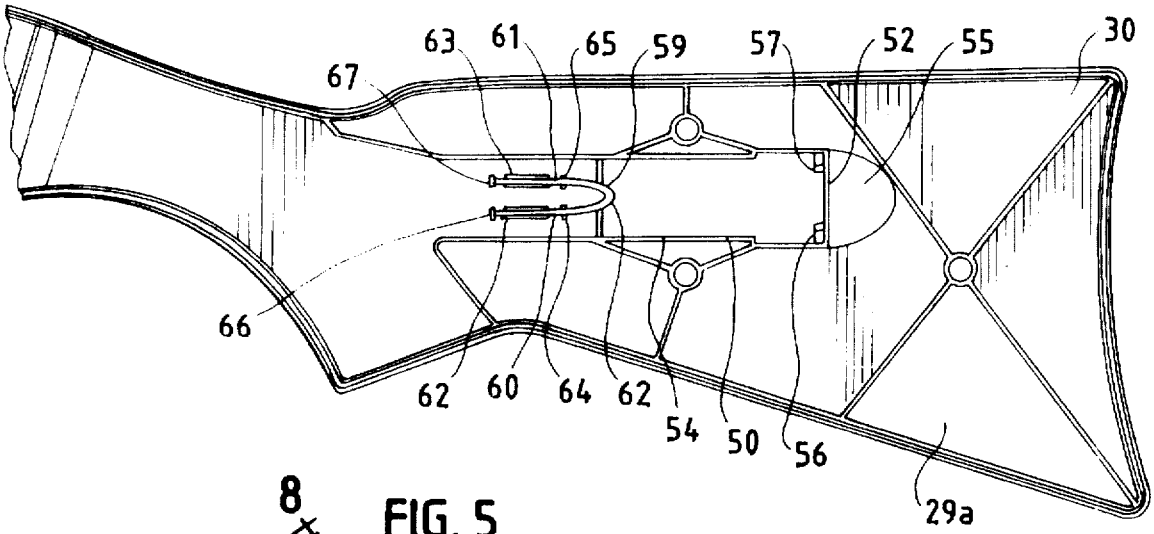
FIG. 4 is a fragmentary view of the inside of the right half of the gun of FIG. 2.
Figure 5:
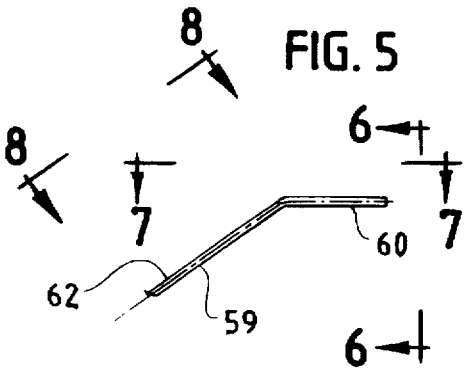
FIG. 5 is a side view of the spring for retaining the BB holder.
Figure 6:
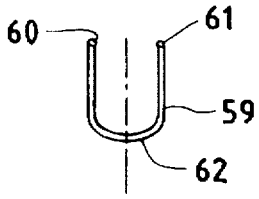
FIG. 6 is an end view of the spring taken along the line 6—6 of FIG. 5.
Figure 7:
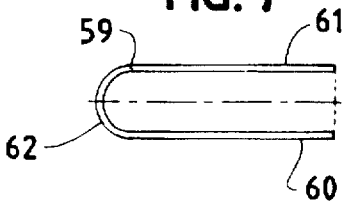
FIG. 7 is a top plan view of the spring taken along the line 7—7 of FIG. 5.
Figure 8:
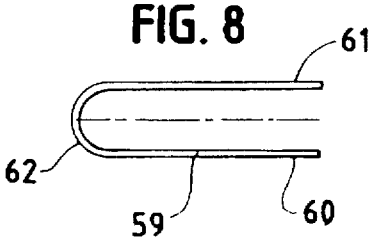
FIG. 8 is a view of the spring taken along the line 8—8 of FIG. 5.

Referring to FIGS. 2 and 4, the right half **29*a* of the frame is provided with an opening 50 which has substantially the same shape as the holder 10 and which has front and rear edges 51 and 52 and longitudinal top and bottom edges 53 and 54. The rear edge 51 of the opening is provided by a laterally inwardly extending ramp 55 on the right frame half. A pair of tabs 56 and 57 extend forward from the rear edge of the ramp, and a rib 58 (FIG. 4**) extends inwardly from the rear edge.

A U-shaped spring 59 extends rearwardly and laterally inwardly from the front edge 55. Referring to FIGS. 5–8, the spring includes a pair of legs 60 and 61 and an angled U-shaped bight portion 62. The legs 60 and 61 are inserted into and retained by a pair of elongated retaining clips 62 and 63 (FIG. 4) and a pair of short retain ribs 64 and 65. The ends of the legs 60 and 61 abut stop pins 66 and 67. The angled portion 62 of the spring extends inwardly toward the left frame half 29*b*.

The BB holder is inserted into the chamber 46 by inserting the bottom end 14 of the holder into the opening 50 and against the U-shaped end 62 of the spring 59. The BB holder is pushed against the spring until the rim 24 of the cap 12 can be inserted in front of the taps 56 and 57. The BB holder is then released, and the spring 59 provides an axial or longitudinal force which pushes the cap of the BB holder rearwardly against the tabs. The left half 29*b* of the frame is provided with a rib 69 (FIG. 9) which surrounds the BB holder when the BB holder is inserted in the pocket. When the BB holder is inserted in the pocket, the bottom wall 14 of the body closes the loading port 48 of the BB reservoir 47 and prevents BB's from spilling out of the reservoir.

In order to load the BB reservoir, the BB holder is removed from the chamber 46. The inwardly inclined ramp 55 enables a finger to be inserted against the end wall of the cap 12 to pry the cap and the holder out of the chamber 46.

The cap is removed from the body, and BB's are poured from the body into the chamber 46. The BB's flow through the port 48 into the reservoir 47. The BB holder is then reinserted into the chamber 46 to close the port.

The reservoir is connected to the BB magazine by a tubular passage 70 formed by ribs on the frame halves. BB's can flow from the reservoir to the magazine by first pulling the BB pusher 43 rearwardly against the force of the spring 44 to open the passage 70. As is well known in the art, a pin on the BB pusher extends outwardly through a slot in the frame half 29*b* to enable the BB pusher to be pulled rearwardly. The magazine can then be filled by tilting the gun so that BB's flow from the reservoir to the magazine.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. In a gun having a receiver and a stock attached to the receiver, means in the receiver for firing BB's from the gun, and a BB reservoir in the receiver for feeding BB's to the firing means, the improvement comprising:

a holder for BB's including an elongated cylindrical body having a cylindrical side wall, a bottom wall, and an open top end, and a cap having a cylindrical side wall which is telescopingly received on the side wall of the body and a top wall, the stock being provided with a chamber for storing said holder.

2. The structure of claim 1 including a spring in the chamber for providing an axially directed force on the holder for resiliently holder the holding in the chamber.

3. The structure of claim 1 in which the stock is provided with an opening which extends from the chamber to the BB reservoir, the holder closing the opening when the holder is stored in the chamber.

4. In a gun having a receiver and a stock attached to the receiver, the improvement comprising a holder for BB's including an elongated cylindrical body having a cylindrical side wall, a bottom wall, and an open top end, and a cap having a cylindrical side wall which telescopes relative to the side wall of the body and a top wall, the stock being provided with a chamber for storing said holder.

5. The structure of claim 4 including a spring in the chamber for providing an axially directed force on the holder for resiliently holding the holder in the chamber.

6. The structure of claim 5 in which the stock is provided with a BB reservoir and an opening which extends from the chamber to the BB reservoir, the holder closing the opening when the holder is stored in the chamber.

7. A holder for BB's comprising:

an elongated plastic body having a cylindrical side wall, a bottom wall, and an open top end, a pair of tabs on the side wall of the body which extend laterally outwardly from the side wall, a portion of the side wall of the body adjacent each tab being provided with a pair of slits to provide a resiliently bendable mounting portion for the tab, and a plastic cap having a top wall and a cylindrical side wall which is ensleeved over the side wall of the body, the top wall being provided with a pair of openings through which the tabs extend whereby the tabs releasably lock the cap on the body.

8. The holder of claim 7 in which each of the tabs includes a camming surface which is engageable by the cap when the cap is rotated whereby the cap can be removed from the body by rotating the cap relative to the body to engage the camming surfaces.

9. The holder of claim 8 in which the top wall of the cap extends radially outwardly beyond the side wall of the cap to provide an annular rim and the holder has the configuration of the shot gun shell.

* * * * *

UNITED STATES PATENT AND TRADEMARK OFFICE

CERTIFICATE OF CORRECTION

PATENT NO. : 5,755,055

DATED : May 26, 1998

INVENTOR(S) : Gregg Thompson et al

It is certified that error appears in the above-indentified patent and that said Letters Patent is hereby corrected as shown below:

Col. 4, line 6 change the second occurrence of "holder" to --holding-- and change "holding" to --holder--.

Signed and Sealed this

Fourteenth Day of July, 1998

Bruce Lehman

*Attest:*

BRUCE LEHMAN

*Attesting Officer*

*Commissioner of Patents and Trademarks*